United States Patent [19]

Shirai et al.

[11] Patent Number: 4,549,603

[45] Date of Patent: Oct. 29, 1985

[54] HEAT EXCHANGING DEVICE WITH HEAT EXCHANGING PLATES

[75] Inventors: Mitsuru Shirai; Nobuo Fukuda; Akira Yamamoto; Hiroshi Tsuji, all of Amagasaki, Japan

[73] Assignee: Mitsubishi Denki Kabushiki Kaisha, Tokyo, Japan

[21] Appl. No.: 566,447

[22] Filed: Dec. 28, 1983

[30] Foreign Application Priority Data

Mar. 8, 1983 [JP] Japan ..... 58-34350

[51] Int. Cl.[4] ..... F28F 9/26

[52] U.S. Cl. ..... 165/104.33; 165/108; 165/130; 165/175; 165/178

[58] Field of Search ..... 165/108, 130, 104.33, 165/170, 175, 176, 178

[56] References Cited

U.S. PATENT DOCUMENTS 2,554,185 5/1951 Giegerich ..... 165/104.33

3,294,082 12/1966 Norris ..... 165/170 X 4,448,245 5/1984 de Palezieux ..... 165/178 X

FOREIGN PATENT DOCUMENTS 819022 10/1937 France ..... 165/170

*Primary Examiner*—Sheldon J. Richter

*Attorney, Agent, or Firm*—Sughrue, Mion, Zinn, Macpeak and Seas

[57] ABSTRACT

A convection flow heat exchanger comprises peripherally flanged upper and lower manifolds 14, 15 connected between a transformer housing 2 and an array of parallel heat exchanging plates 12 having internal fluid passages. The manifolds have openings 16 which mate with correspondingly configured openings 13 in upper and lower corners of the plates. This arrangement eliminates bottlenecks in and simplifies the cooling fluid flow path, and enables the effective heat exchange area to be increased.

2 Claims, 7 Drawing Figures

HEAT EXCHANGING DEVICE WITH HEAT EXCHANGING PLATES

BACKGROUND OF THE INVENTION

This invention relates to a parallel plate heat exchanger for cooling large transformers.

Referring to FIGS. 1–3 which illustrate a conventional heat exchanger, a heat generating unit 1 such as a transformer is mounted within an enclosure or housing 2 having a sidewall 2*a*. The heat exchanger 3 comprises parallel metallic plates 5, plenums 8 and connecting tubes 9. The plates 5 are each formed by overlying a pair of plates 51 as shown in FIG. 2, welding along lines 6, and expanding the space between the plates 51 with compressed air. Openings 7 are provided at the top and bottom of each plate. The enclosure 2, the plenums 8, the tubes 9 and the plates 5 are filled with a heat conveying fluid 4. The adjacent folded ends 5*a* of the plates 5 are welded together to form the parallel plate unit.

The plenums 8 communicate with the openings 7, and the tubes 9 communicate between the interior of the housing 2 and the plenums at the top and bottom of the sidewall 2*a*. Heat generated by the unit is dissipated through the plates 5 in a well known manner by the convection flow of the fluid 4 through the upper tube 9, the upper plenum 8, the plates 5, the lower plenum 8, and back through the lower tube 9 into the housing 2.

In such a conventional heat exchanger the cooling efficiency is reduced by the low fluid flow velocity due to the relatively large resistance and complex flow path defined by the plenums 8 and tubes 9.

The length L of each plate 5 must be at least twice the diameter D of the tubes 9 or the height D of the plenums 8, but shorter than the height H of the enclosure 2. The radiating surface S of the heat exchanger 3 may be expressed as $S=nwL$, where n, w and L indicate the number of plates 5, the width of each plate and the length of each plate 5, respectively. The width w or the number n of plates must thus increase, and attendantly the mass of the heat exchanger, as the length of the plates decreases.

In stamping out the plates 51 from blanks 11 (FIG. 3), the four corners 10 are discarded, and this increases the cost of the heat exchanger. Further, when the heated air rises up between the plates 5, its smooth flow path is disturbed by the obstacles represented by the plenums and tubes, and this lowers the cooling efficiency and capacity of the unit.

SUMMARY OF THE INVENTION

It is an object of this invention to provide a new and improved heat exchanger which has increased cooling efficiency, decreased mass, and which is less costly to manufacture.

This object is accomplished by providing a heat exchanger having flanged upper and lower manifolds mounted directly on the housing sidewall, which are joined to the parallel heat exchanging plates at upper and lower corner openings thereof.

DETAILED DESCRIPTION OF THE PREFERRED EMBODIMENT

Figure 5:
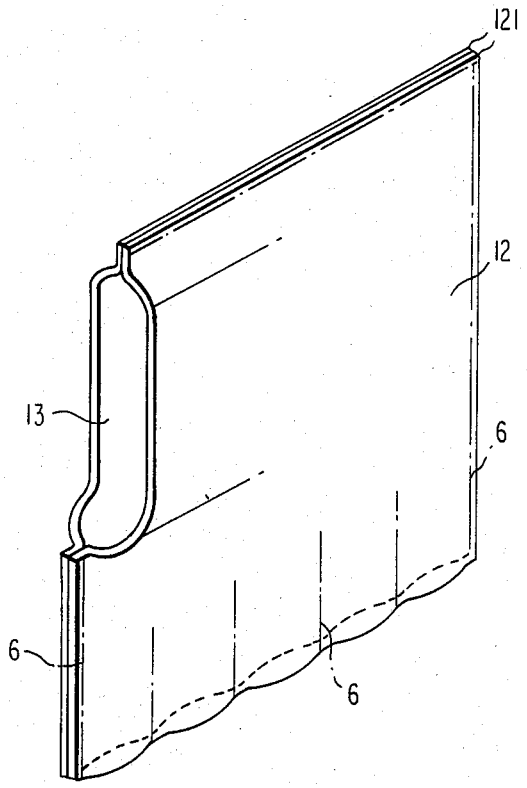
FIG. 5 is an enlarged perspective view of a corner of a plate used in FIG. 4.
Figure 6:
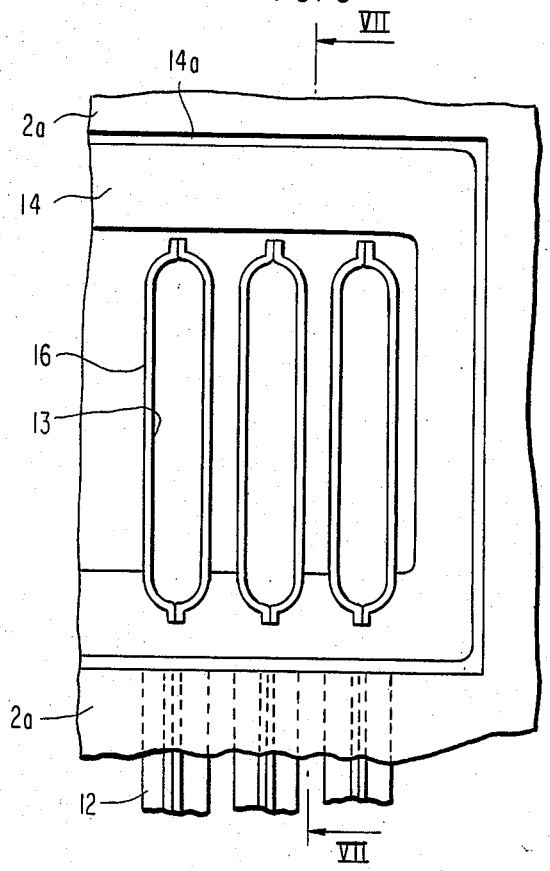
FIG. 6 is a partial view of a connection manifold as seen from inside the transformer housing.
Figure 7:
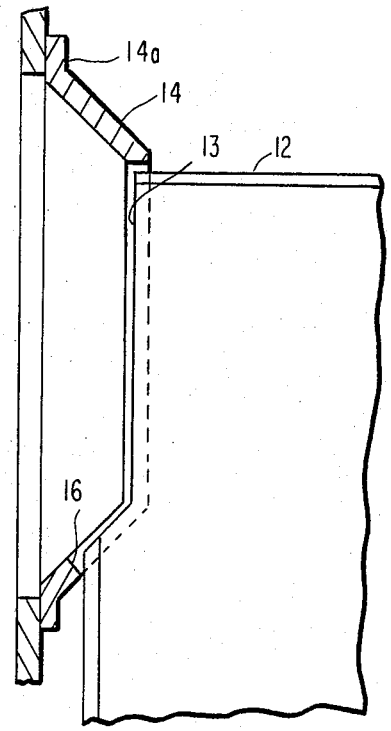
FIG. 7 is a sectional view along line VII—VII in FIG. 6.

In accordance with the embodiment of the invention shown in FIGS. 4 through 7, a metallic plate 12 is formed by overlaying two plates 121 and welding along lines 6 as shown in FIG. 5, and then expanding the space between the plates with compressed air to form the fluid flow passages. Each rectangular plate 12 has openings 13 at its upper and lower corners. Upper and lower connection manifolds 14, 15 having flanges 14*a*, 15*a* are welded to rectangular openings in the sidewall 2*a* of the housing 2. Openings 16 in the outer walls of the manifolds and the openings 13 of the plates are matingly configured, and are joined together in a fluid tight manner as shown in FIGS. 6 and 7, for example by welding.

The fluid 4 heated by the unit 1 circulates through the upper manifold 14, the upper openings 13 of the plates 12, the flow passages within the plates, the lower openings 13 of the plates, the lower manifold 15, and back into the housing 2. The heat carried by the fluid is released into the surrounding atmosphere from the plates 12.

Figure 1:
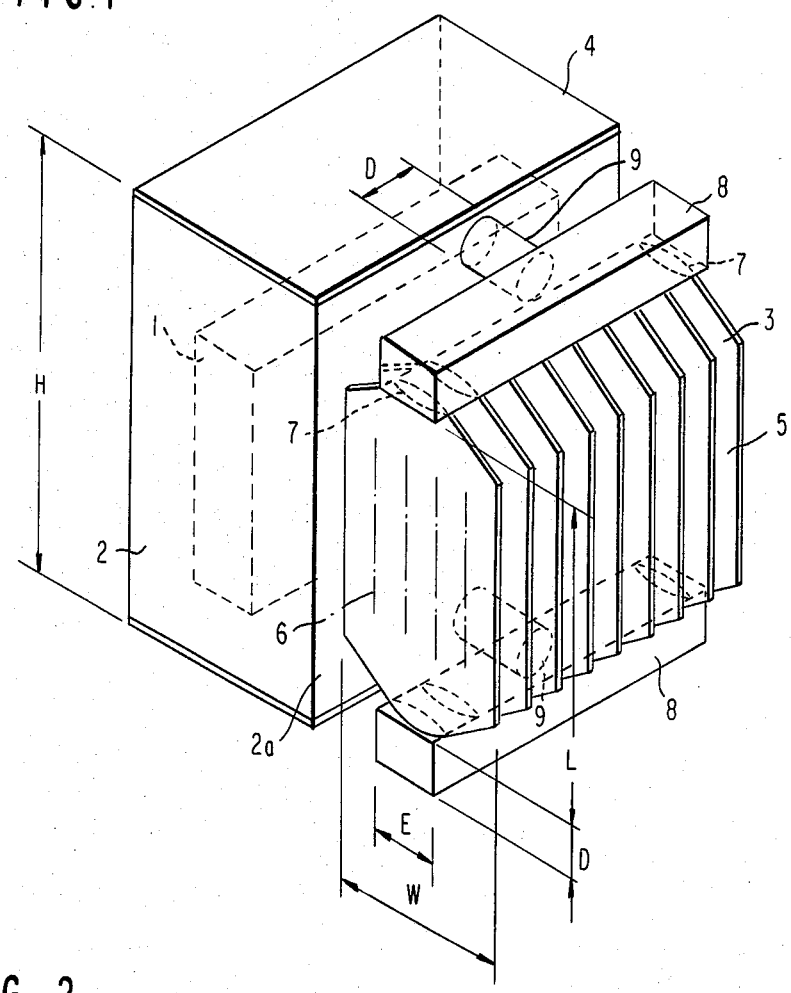
FIG. 1 PRIOR ART
FIG. 1 is a perspective view of a conventional heat exchanger.
Figure 2:
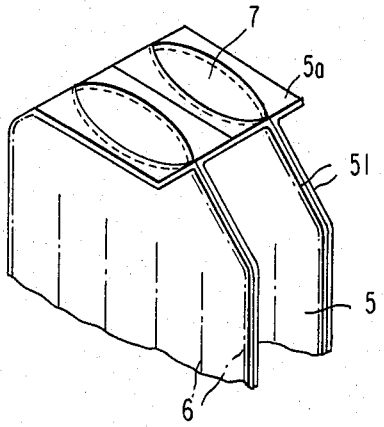
FIG. 2 PRIOR ART
FIG. 2 is an enlarged perspective view of the plate unit used in FIG. 1.
Figure 3:
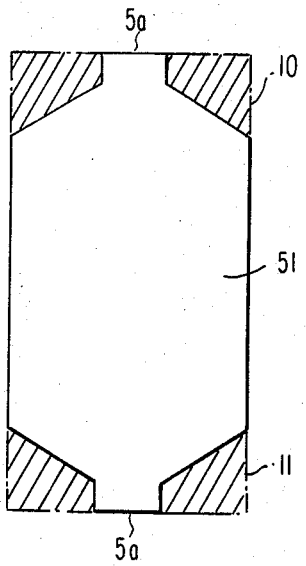
FIG. 3 PRIOR ART
FIG. 3 is a plan view of a metal blank from which the plate members are stamped out.
Figure 4:
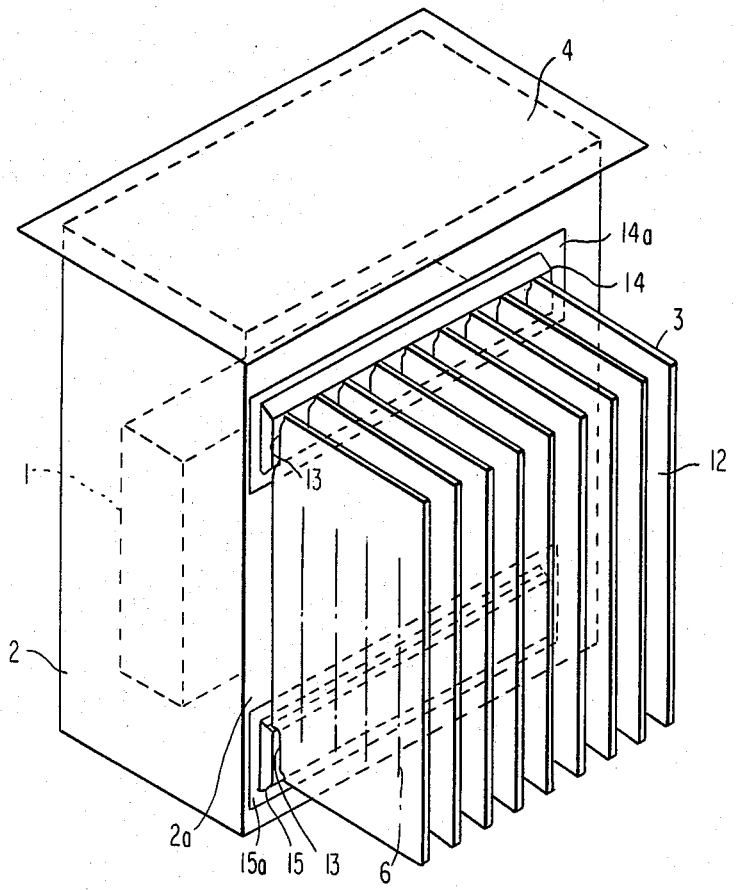
FIG. 4 is a perspective view of one embodiment of this invention.

The connection manifolds 14, 15 directly communicate between the housing 2 and the plate unit 3 to form simple and low resistance passages for the fluid medium, and the height L of the plates is greater than the plate height in the conventional unit of FIGS. 1–3. This increased cooling efficiency allows the number of plates or the width of the plates to be reduced, which decreases the overall mass of the unit. The shape of the plates is simplified in comparison with the prior art, and they can be easily maufactured without any significant material waste. The number of parts of the heat exchanger is reduced which further lowers the manufacturing cost, and the air flow up through the plates is smooth and free of any obstructions.

In the above description the metallic plates are formed by welding a pair of plates together and expanding them with compressed air, but they may also be made by first press-shaping the halves and then welding them together.

What is claimed is:

1. A heat exchanger for a heat generating unit (1) mounted within a fluid enclosure (2), comprising:

(a) spaced upper and lower flanges (14*a*, 15*a*), horizontally elongate connecting manifolds (14, 15) mounted around horizontally elongate upper and lower first openings in a sidewall (2*a*) of the enclosure, said manifolds thus communicating directly with the interior of the enclosure, and each having an outer wall projecting horizontally outwardly from the enclosure sidewall and defining a plurality of spaced, horizontally aligned, vertically oriented second openings (16), and (b) a plurality of spaced, parallel, horizontally aligned and vertically oriented, substantially rectangular heat exchanging plates (12) each defining a plurality of vertical internal fluid flow passages integral and unitary with and openly communicating at tops and bottoms thereof with respective upper and lower horizontal plenums, said plenums individually defining respective vertically oriented third openings (13) at upper and lower corners of one side of said plates, said third openings being matingly configured to said second openings, and said plates being individually and sealingly mounted to said upper and lower manifolds such that said second and third openings are coextensive and define through passages communicating between the interiors of the enclosure and the respective plates, the outer wall of each manifold projecting horizontally outwardly from the enclosure sidewall only a small fraction of the horizontal width of the plates.

2. A heat exchanger as defined in claim 1, wherein the second and third openings are vertically elongate and are bent at an end towards a central area of the enclosure.

* * * * *